US006237455B1

(12) United States Patent
Mierau et al.

(10) Patent No.: US 6,237,455 B1
(45) Date of Patent: May 29, 2001

(54) KNIFE PROJECTION SENSING SYSTEM

(75) Inventors: Cameron Dean Mierau, Portland, OR (US); James Gary Irwin, Burnaby (CA)

(73) Assignee: Cae Machinery Ltd., Vancouver (CA)

( * ) Notice: Subject to any disclaimer, the term of this patent is extended or adjusted under 35 U.S.C. 154(b) by 0 days.

(21) Appl. No.: 09/544,920

(22) Filed: Apr. 7, 2000

Related U.S. Application Data

(62) Division of application No. 08/692,683, filed on Aug. 6, 1996, now Pat. No. 6,142,046.

(51) Int. Cl.[7] ..... B26D 1/00
(52) U.S. Cl. ..... 83/13; 83/62; 83/62.1
(58) Field of Search ..... 83/13, 62, 62.1, 83/835

(56) References Cited

U.S. PATENT DOCUMENTS

| | | | | |
|---|---|---|---|---|
| 3,533,322 | * | 10/1970 | Offenstadt . | |
| 3,799,021 | * | 3/1974 | Hammerschlag | 83/490 |
| 3,843,871 | * | 10/1974 | Fujimaki et al. | 83/62.1 |
| 4,077,448 | * | 3/1978 | Hasenwinkle et al. . | |
| 4,116,095 | * | 9/1978 | Cousino | 83/488 |
| 4,289,053 | * | 9/1981 | Sawamura . | |
| 4,498,345 | * | 2/1985 | Dyer et al. | 83/522.16 |
| 4,506,575 | * | 3/1985 | McCay et al. . | |
| 4,537,177 | * | 8/1985 | Steere, Jr. et al. | 125/13.02 |
| 4,625,605 | * | 12/1986 | Buta . | |
| 4,771,665 | * | 9/1988 | Van Doorn et al. | 83/62.1 |
| 4,817,692 | * | 4/1989 | Denis | 83/835 |
| 4,878,407 | * | 11/1989 | Harrison et al. | 83/62.1 |
| 4,950,986 | * | 8/1990 | Guerrero . | |
| 4,971,021 | * | 11/1990 | Kubotera et al. | 125/13 |
| 4,974,578 | * | 12/1990 | Charles et al. | 83/647.5 |
| 5,031,360 | * | 7/1991 | Farnsworth et al. | 83/62.1 |
| 5,038,647 | * | 8/1991 | Biagiotti | 83/458 |
| 5,069,098 | * | 12/1991 | Cavagna | 83/62.1 |
| 5,179,879 | * | 1/1993 | Yerly | 83/604 |
| 5,303,687 | * | 4/1994 | Steere | 83/663 |
| 5,373,875 | * | 12/1994 | Fenton et al. | 83/788 |

FOREIGN PATENT DOCUMENTS

| | | | | |
|---|---|---|---|---|
| 0113583 | * | 9/1979 | (JP) | 83/62.1 |

* cited by examiner

*Primary Examiner*—M. Rachuba
(74) *Attorney, Agent, or Firm*—Townsend and Townsend and Crew LLP

(57) ABSTRACT

A knife projection sensing system for cutting machines having a rotatable surface adapted to retain a plurality of cutting knives. The system employs a plurality of sensors mountable to the cutting machine to be stationary with respect to the rotatable surface. The sensors generate a signal capable of indicating the position of each cutting knife as the knives rotate past the sensors. A microprocessor in communication with the sensors analyzes the signal generated to determine the projection of each knife from a reference surface and to determine if the projection of at least one of the plurality of cutting knives deviates outside preset desirable limits. The projection status of the knives is communicated to an operator by a light display or paper printout. The system can be used to ensure that knives are correctly installed in the cutting machine and to monitor knife position during normal operation. The system can also be used to determine when knives need changing for sharpening. If the projection of the knives exceeds preset limits, the system will automatically shut down the cutting machine to prevent damage.

9 Claims, 6 Drawing Sheets

KNIFE PROJECTION SENSING SYSTEM

CROSS-REFERENCE TO RELATED APPLICATIONS

This application is a divisional of Ser. No. 08/692,683, filed Aug. 6, 1996, now U.S. Pat. No. 6,142,046 issued Nov. 7, 2000.

FIELD OF THE INVENTION

This invention relates to an apparatus and method or sensing the position of knives in a cutting machine.

BACKGROUND OF THE INVENTION

Cutting machines that include a rotatable knife older to which are clamped a plurality of cutting knives are well known in the wood machining industry. Wood to be processed in the form of raw logs or processed lumber is fed into the cutting machines and the rotating knives rapidly convert the logs or lumber into chips, flakes, particles or other products. Examples of such machines used in the forest products industry include:

1) chippers and hogs used in saw mills, pulp mills, chipping plants and mobile units to make pulp chips or mulch;
2) planners, matchers, milling machines and routers used in lumber mills to finish the surface of lumber or in manufacturing plants to shape wood;
3) waferizers and flakers used to make particles or flakes for manufacture of wood products such as oriented strand board (OSB) and particle board.

The cutting machines described above employ numerous different configurations with respect to knife clamping arrangements, however, they are all governed by the same design considerations.

The knives are subjected to large centrifugal forces and the knife clamping force must be sufficient to retain the knives in place. Furthermore, in performing their cutting action, the knives tend to be pulled from or pushed into the knife clamp and the knife clamping force must be sufficient to overcome these forces. A safety hazard exists if knives come loose during operation of the cutting machine as the rotation speed of the knives tends to throw them outwardly with great force. In addition, the rotating knives often come into close proximity with stationary parts of the cutting machine and even slight movements of the knives can cause collisions and resulting catastrophic failure of the cutting machine.

The position and condition of the cutting knife edge is important in the cutting process. Particularly when flakes or chips are being formed, the position and sharpness of the knife edge is vital to the quality of product being produced. The knife edges dull and retract with use making it necessary to sharpen and reposition the knives periodically which requires stopping the cutting machine to gain access to the knives.

It is readily apparent from the foregoing discussion that cutting knife position is an important element of cutting machine design and operation. It is recognized that it would be advantageous to be able to monitor the position of the cutting knives in a cutting machine to prevent failures, to assist in scheduling of regular maintenance and sharpening of equipment and to ensure product quality. Visual inspection of the knives during operation is not possible as the configuration, presence of guard screens, size and rotating speed of cutting machines generally prevents an operator from observing the knives while the machine is working.

SUMMARY OF THE INVENTION

Accordingly, there is a need for a knife projection monitoring system that permits rapid and efficient inspection of the cutting knives particularly during operation. Applicant has developed a knife projection monitoring system that functions to ensure that cutting knives are installed properly and that knives remain in their proper position during use. In addition, the system permits knives to be easily monitored for changing or sharpening as necessary. The system relies on stationary sensors that generate a signal containing information about the rotating knife holder and knives of the cutting machine. The signals are analyzed to isolate the position of each of the cutting knives and to determine the projection of each knife while the cutting machine is operating. The actual projection of the knives is compared to desired pre-set limits, and, if the limits are exceeded, a warning can be sent to the operator to prompt appropriate corrective action or a signal can be sent from the system to the cutting machine to shutdown automatically.

In a first aspect the present invention provides a knife projection sensing system for cutting machines having a rotatable surface adapted to retain a plurality of cutting knives comprising:

at least one sensor mountable to the cutting machine to be stationary with respect to the rotatable surface for generating a signal capable of indicating the position of each cutting knife as the knives rotate past the at least one sensor;

processing means in communication with the at least one sensor for analyzing the signal generated to determine the projection of each knife from a reference surface and to determine if the projection of at least one of the plurality of cutting knives deviates outside preset desirable limits; and means for communicating the projection status of the knives to an operator.

Preferably, the system includes a visual display using indicator lights or an audible alarm to notify the operator. In addition, a printer interface allows a printer to be connected to the system so that a hardcopy of knife projection distances over time can be produced as a permanent record for future analysis or for maintenance purposes.

In a further aspect the present invention provides a method for monitoring the position of cutting knives in a cutting machines having a rotatable surface adapted to retain a plurality of cutting knives comprising the steps of:

detecting the cutting knives using at least one stationary sensor as the knives rotate past the sensor, the sensor generating a signal capable of indicating the position of each cutting knife;

analyzing the signal generated by the at least one stationary sensor to determine the projection of each knife from a reference surface; and comparing the projection of each knife with preset desirable limits to determine if at least one of the knives exceeds the limits.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
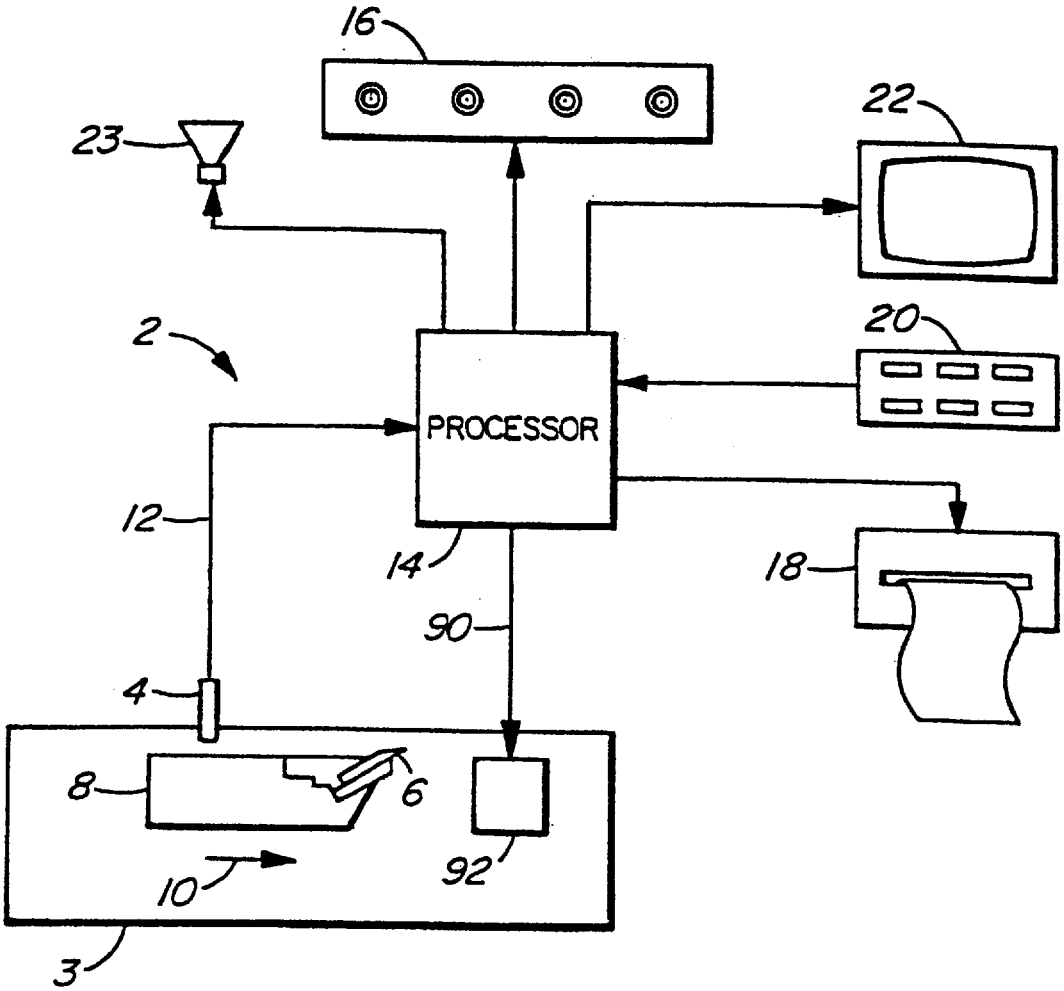
FIG. 1 is a schematic view showing the components of the knife projection monitoring system according to the present invention.

Referring to FIG. 1, there is shown a schematic diagram of the general components that make up the knife projection sensing system 2 of the present invention adapted for use with cutting machines that employ a rotatable surface adapted to retain a plurality of cutting knives that extend outwardly from the rotatable surface. In the wood machining industry, such cutting machines include chippers, hogs, planners, routers, waferizers and flakers. Examples of a disc flaker and ring flaker fitted with the system of the present invention are discussed below. It will be understood by one skilled in the art that the monitoring system of the present invention is not limited to these particular cutting machines. With appropriate modifications to sensor location and sensor signal analysis software, it will be readily apparent to a person skilled in the art that the monitoring system of the present invention can be used to monitor any cutting machine that employs mounted cutting knives that project from a rotating surface.

The monitoring system of the present invention as illustrated in FIG. 1 generally comprises at least one sensor 4 mountable to a cutting machine 3 in a fixed location adjacent to the cutting knives 6 such that the knives mounted to rotatable surface 8 move past sensor 4 as indicated by arrow 10 during normal operation of the cutting machine. Sensor 4 generates a signal that is capable of indicating the position of each cutting knife 6 as the knives rotate past the sensor in sequence. Sensor 4 is connected via cable 12 with processing means in the form of a microprocessor 14 running a program for analyzing the generated signal to determine the projection of each knife 6 from a reference surface which is the rotatable surface 8 carrying the knives. Microprocessor 14 also determines if the projection of any one of the plurality of cutting knives 6 deviates outside preset desirable limits. Microprocessor 14 is programmed to notify the operator of cutting machine 3 if knife projection varies from preset limits via means for communicating the projection status of the knives comprising an array of status lights 16 or printer 18.

To increase the flexibility of the monitoring system, microprocessor 14 is programmable via input means comprising a keypad 20 to permit adjustment of configuration information such as the preset limits for the knife projection and the number of sensors to be monitored. Preferably, display means in the form of an LCD display 22 is provided to allow an operator to review current configuration information as well as monitor changes in the configuration made using keypad 20.

The foregoing is a general description of the components of the present invention and the manner in which they are connected to each other. Details of the various components are best provided by considering an knife monitoring system installed on a specific cutting machine.

Figure 3:
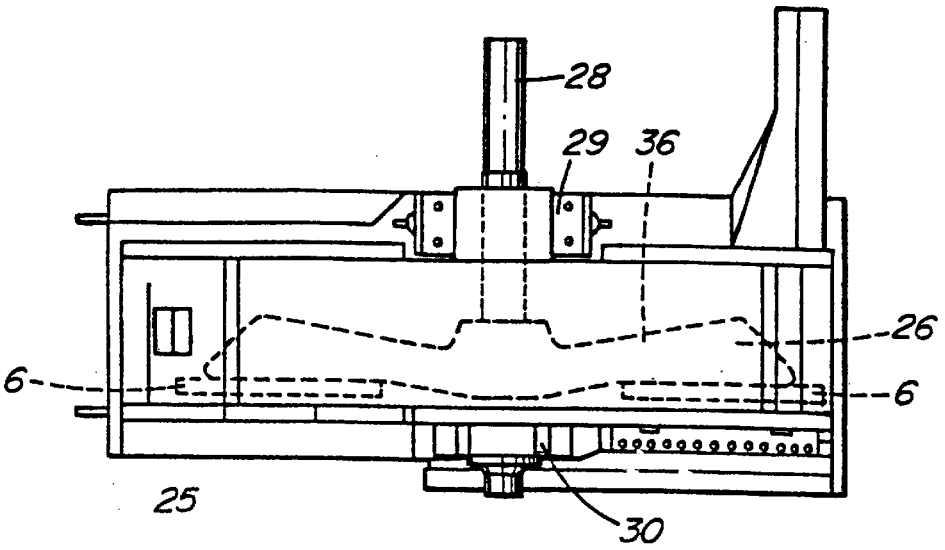
FIG. 3 is a plan view of the disc flaker of FIG. 2.
Figure 2:
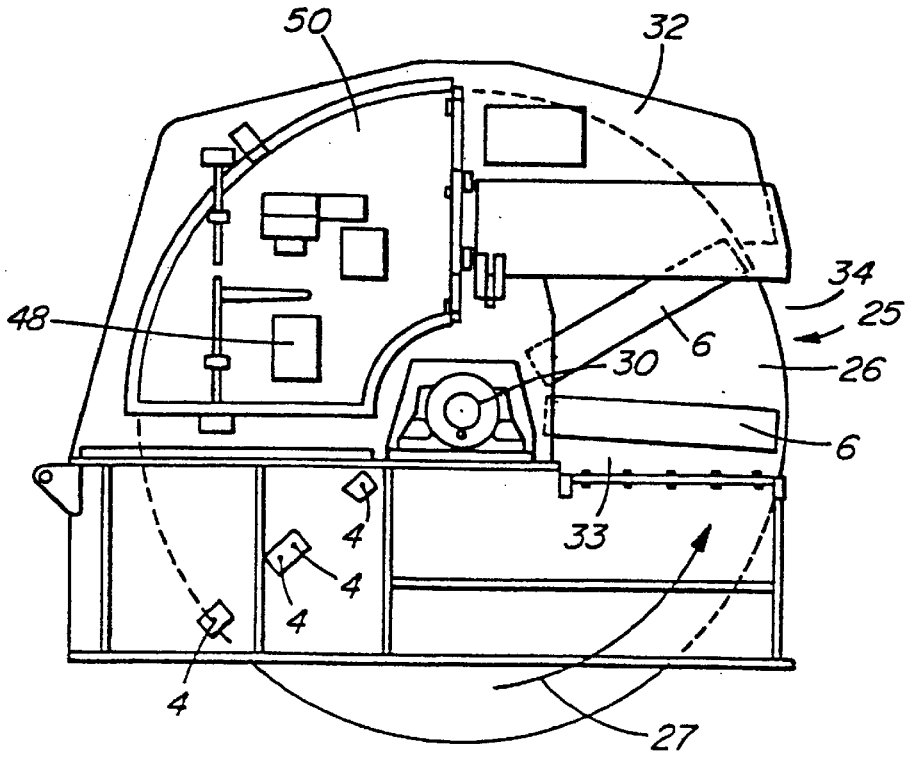
FIG. 2 is a front elevation view of a disc flaker fitted with the knife projection monitoring system of the present invention.

FIGS. 2 and 3 show a conventional disc flaker 25 fitted with the knife monitoring system 2 of the present invention. The rotatable surface of the flaker comprises a disc 26 mounted to a rotatable shaft 28 supported by bearings 29 and 30. A motor (not shown) drives shaft 28 to rotate disc 26 at operating speeds in the direction indicated by arrow 27. A series of knives 6 are radially mounted to the front face 33 of disc 26. Disc 26 rotates within a guard enclosure 32 having a window 34 into which logs to be processed are introduced. Logs are pressed against disc 26 by a suitable log conveying system and knives 6 convert the logs into wafers which exit through slots 35 in the disc adjacent each knife 6 to the rear face 36 of the disc for collection.

Figure 4:
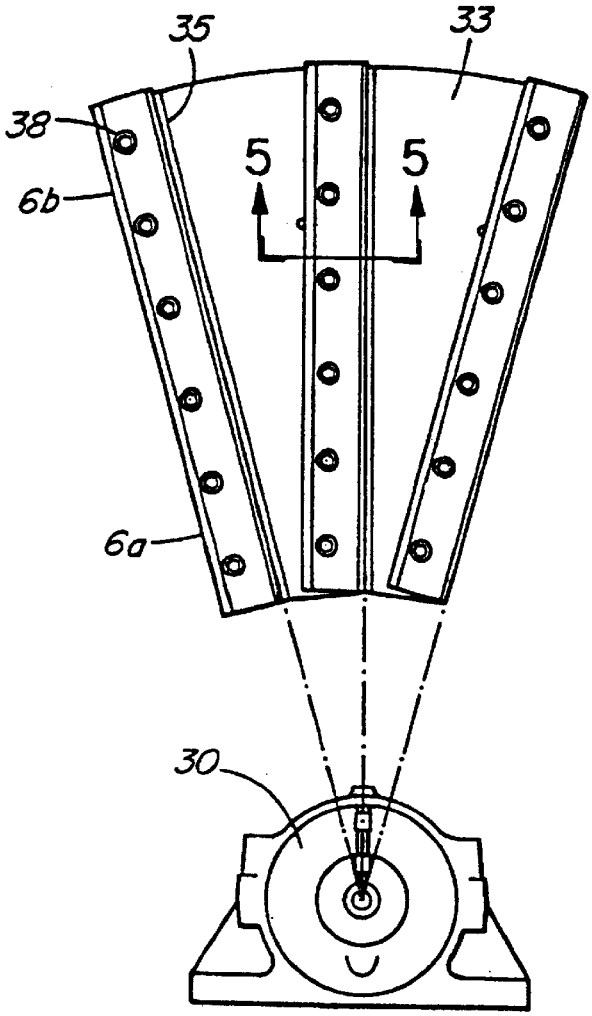
FIG. 4 is a detail view of a portion of the disc flaker surface showing the mounting of the cutting knives.
Figure 5:
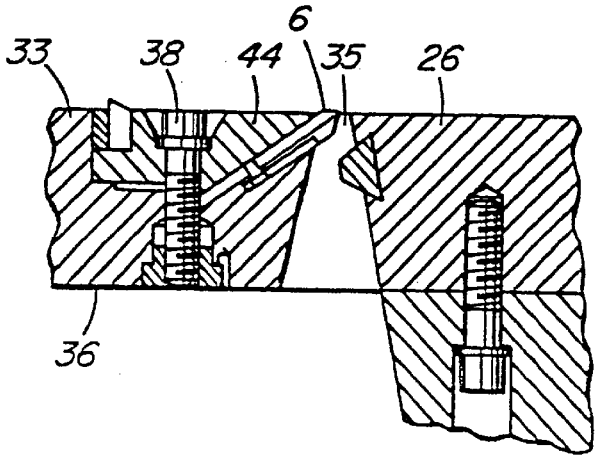
FIG. 5 is a detail section view taken along line 5—5 of FIG. 4 showing a mounting arrangement for the cutting knives.

FIGS. 4 and 5 are detail views showing a conventional manner in which knives 6 are attached to disc 26. As best shown in FIG. 4, knives are secured to front face 33 by a plurality of bolts 38 to extend along radii of the disc. In the illustrated arrangement, a pair of inner and outer knives 6*a* and 6*b*, respectively, are mounted along radii of the disc, each knife being secured by three bolts 38.

FIG. 5 is a section view taken along line 5—5 of FIG. 4 and shows that each knife 6 is located in place adjacent a slot 35 by a clamp 44 that is held in place by bolts 38. This construction permits knives 6 to be securely held in place and readily removed and replaced as the knife edges become dull. It also permits adjustment of the extent to which knife 6 projects outwardly from the front face 33 of disc 26.

Referring to FIG. 2, the disc flaker just described has been modified to incorporate the knife projection sensing system previously described. A series of four sensors 4 are mounted to guard enclosure 32 to extend through the enclosure along a radius of disc 26. Effectively, the sensors are stationary with respect to the rotatable knives of the disc and the sensors are preferably positioned adjacent each end of the inner and outer knives 40 and 42 as shown. Sensors 4 are connected by cables to a control unit 48 that is mounted to guard enclosure 32 or to a wall adjacent the cutting machine. Control unit 48 can be mounted to the conventional access panel 50 formed in guard enclosure 32 that operators use when performing maintenance on the disc knives. Control unit 48 contains microprocessor 14 and the other peripheral devices illustrated schematically in FIG. 1 in a compact housing that can be readily accessed and viewed by an operator.

Figure 6:
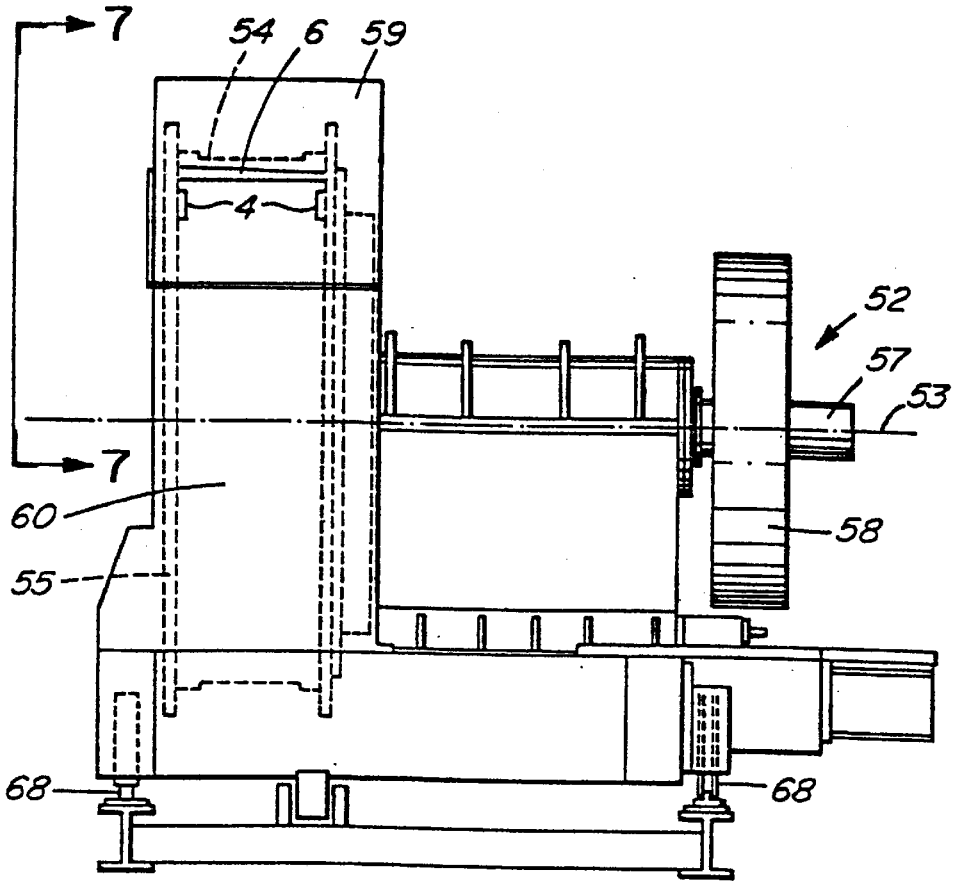
FIG. 6 is a side elevation view of a ring flaker fitted with the knife projection monitoring system of the present invention.
Figure 7:
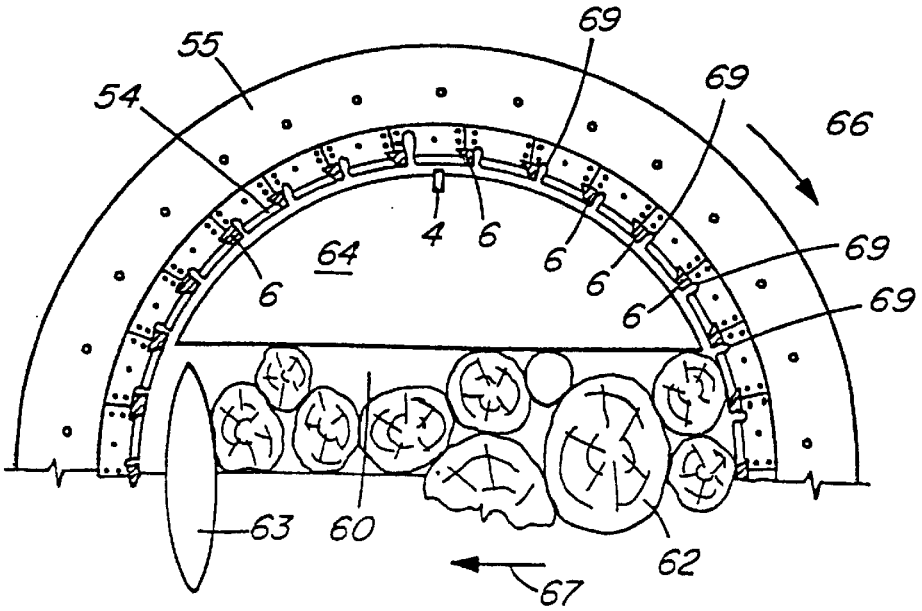
FIG. 7 is a detail view taken along line 7—7 of FIG. 6 showing the mounting of the cutting knives and the position of the sensors.

FIGS. 6 and 7 illustrate another type of cutting machine to which the knife projection monitoring system of the present invention can be fitted. FIG. 6 is a side elevation view of a ring flaker 52 which uses an annular ring assembly 55 as the rotatable surface supporting the cutting knives.

Ring assembly 55 is mounted to the end of shaft 57 which is rotated by a belt drive (not shown) that engages pulley wheel 58. The ring assembly is housed for rotation about axis 53 within a protective shroud 59. Cutting knives 6 are mounted to the inner circumferential surface 54 of ring assembly 55 to extend parallel to the axis of rotation and the cutting edges of the knives project inwardly into the centre of the ring to process logs 62 introduced into the interior 60 of the ring assembly.

FIG. 7 is a view into the interior 60 of the ring assembly taken along line 7—7 of FIG. 6. Interior 60 includes a stationary backstop 63, an upper segment 64 and a corresponding lower segment (not shown) that define a chamber that holds logs 62 to be processed. Ring assembly 55 is rotated in the direction indicated by arrow 66 and advanced in the direction of arrow 67 through the logs to cut the logs into flakes by the action of knives 6. In order to accommodate movement in the direction of arrow 67, the entire ring assembly is supported on rollers 68 (FIG. 6). As flakes are cut, they exit through slots 69 in the ring assembly adjacent each knife for collection in a storage hopper (not shown). Backstop 63 remains stationary with respect to the ring assembly and upper segment 64 and the lower segment move with the ring assembly to contain and hold the logs while being processed. Therefore, upper segment 64 provides an appropriate location for mounting two upwardly oriented sensors 4 to monitor the projection of cutting knives 6. As best shown in FIG. 6, the two sensors are positioned at opposite ends of each cutting knife extending across inner circumferential surface 54 of ring assembly 55. The sensors are connected by cable to a central processing unit as in the previous disc flaker embodiment.

In prototype testing, it has been determined that a proximity sensor capable of detecting the distance between the sensor and a metallic target surface is suitable for use as sensor 6 in the apparatus of the present invention. At the high speeds at which the cutting equipment operates, an electronic linear position sensor such as that manufactured by Kaman Instrumentation under the name KD-2300 is preferred for use as sensor 6 since it is sensitive enough to reliably and accurately detect projection of the cutting knives at the high operating speeds. The sensor operates by providing a signal in the form of an output voltage that is proportional to the distance between the end of the sensor and any metallic target surface.

In the particular examples that have been described above incorporating the knife projection sensing system into a disc and ring flaker, the metallic target surfaces are the mounting surface of the disc or ring and the projecting portion of the cutting knives. Generally, the cutting knives are made from carbon steel and the mounting surface of the disc is a chrome surface. The sensor responds to different metallic materials with a different strength signal even if the surfaces are equidistant from the sensor, that is, the sensor senses different metals at different distances. Therefore, it is necessary to analyze the signal from the sensor to isolate that part of the signal that represents the cutting knife in order to determine the proximity of the knife to the sensor. Analysis of the sensor signal is performed by microprocessor 14 in the control unit to ensure that the knife edge is detected.

Figure 9A:
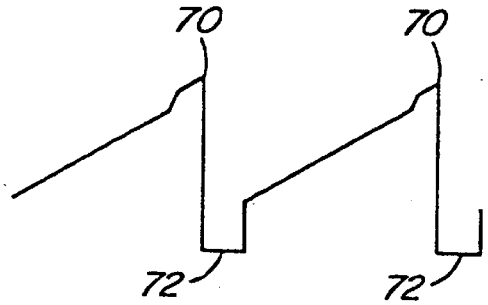
FIG. 9*a* is a representation of the voltage signal provided by a sensor when the cutting knives are mounted to project a relatively large distance from the mounting surface.
Figure 9B:
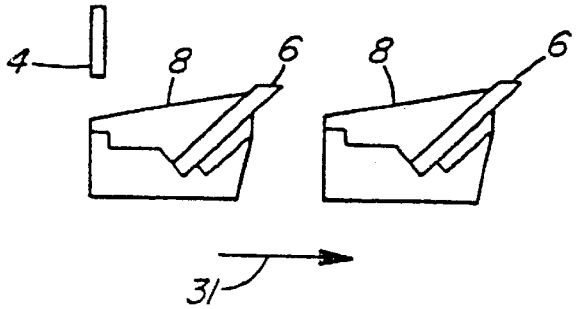
FIG. 9*b* is a schematic view of the cutting knife and mounting surface that generates the signal of FIG. 9*a;*

In some cutting machinery, knife 6 projects a significant distance from other metallic surfaces in the knives' normal operating position. In a chipper for example, the knives generally project 0.38 to 0.75 inches from the other parts of the knife mounting surface. In such a knife arrangement, a voltage signal as illustrated in FIG. 9*a* is delivered by the sensor to microprocessor 14. In FIG. 9*a*, the intensity of the voltage signal is plotted against the position of the sensor over the knife mounting surface as the surface rotates. Directly beneath FIG. 9*a* is FIG. 9*b* which is a schematic view of the apparatus being scanned by sensor 4 to produce the indicated voltage signal. Note the voltage signal has a definite peak 70 adjacent a trough 72. Trough 72 results when the sensor passes over the slot adjacent the cutting knife. Since the cutting knife projects outwardly a significant distance from other components, it is closest to the sensor and generates a definite peak in the signal. Microprocessor 14 is programmed to recognize peak 70 as the cutting edge of the knife and use this point in the signal to calculate the proximity of the cutting knife to the sensor which in turn is used to determine the projection of the cutting knife from mounting surface 8.

Figure 8A:
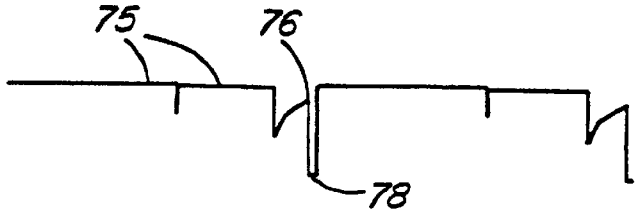
FIG. 8*a* is a representation of the voltage signal provided by a sensor when the cutting knives are mounted to project a relatively small distance from the mounting surface.
Figure 8B:
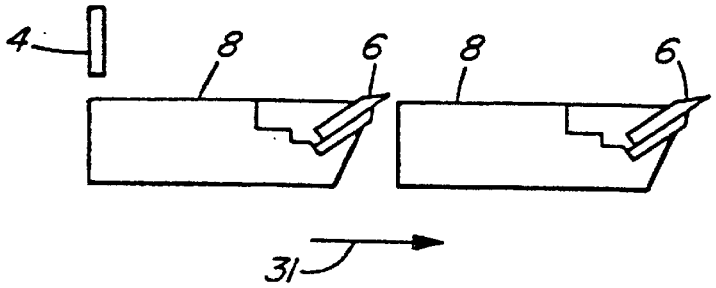
FIG. 8*b* is a schematic view of the cutting knife and mounting surface that generates the signal of FIG. 8*a;*

Alternatively, in other cutting machinery configurations, knife 6 projects only a relatively small amount above other metallic surfaces in the knives' normal operating position. In a waferizer, the knives generally project only 0.015 to 0.050 inches from the other parts of the knife mounting surface. In such a knife arrangement, a voltage signal as illustrated in FIG. 8*a* is delivered by the sensor to microprocessor 14. In FIG. 8*a*, the intensity of the voltage signal is plotted against the position of the sensor over the knife mounting surface as the surface rotates. Directly beneath is FIG. 8*b* which is a schematic view of the apparatus being scanned by sensor 4 to produce the indicated voltage signal as the knife mounting surface rotates in the direction of arrow 31. The knife edge is too close to other parts or there are voltage response differences due to different metallic materials or both to prevent formation of a definite knife peak in the signal. The result is a signal as shown in FIG. 8*a*.

The chrome surfaces of mounting surface 8 produce a signal 75 of greater intensity than the signal 76 generated by a carbon steel knife. The gap adjacent the knife still produces a trough 78. In such cases, microprocessor 14 is programmed to analyze the signal to detect a characteristic waveform shape that indicates the knife cutting edge. Once the knife cutting edge is located, the projection of the knife can be measured.

Sensors have recently been developed that sense various metals at the same distance. For example, Turck Inc. of Plymouth, Minnesota manufactures an Uprox brand sensor designed to detect many metals at the same distance that could be used with the knife projection monitoring system of the present invention. If such a sensor is used, microprocessor 14 would be programmed to recognize the peaks of the sensor signal as the cutting edges of the knives.

Figure 10:
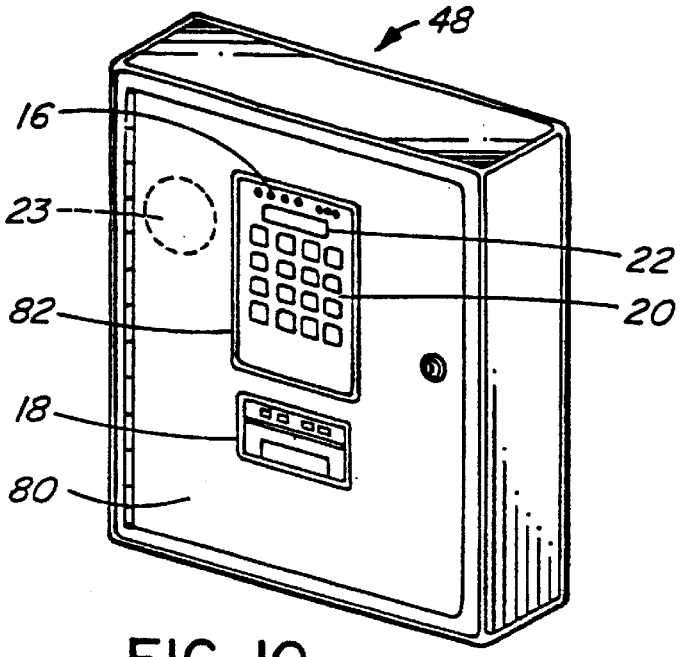
FIG. 10 is a perspective view of a compact housing unit containing the components of the knife projection system of the present invention except for the sensors.
Figure 11:
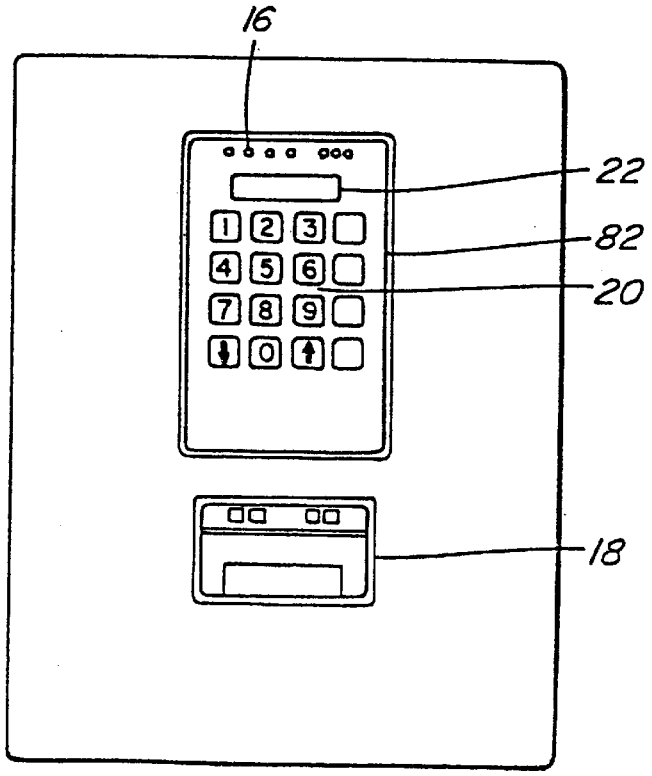
FIG. 11 is a detail view of the front panel of the housing showing indicator lights, keypad and display and printer.

FIG. 10 is a perspective view of the compact control unit 48 housing all the components of the knife projection system except for sensors 4 and connecting cables 12. Unit 48 comprises a box enclosure having a hinged, lockable door 80 to prevent unauthorized access to the internal components of the system. Door 80 includes a control panel 82 and a printer 18 that are shown in more detail in FIG. 11.

Control panel 82 includes keypad 20 that allows the user to select or enter information required to operation the knife projection monitoring system. Keypad 20 allows for adjustment of various system parameters including the number of knives being monitored, the number of sensors doing the monitoring, the knife projection limits that the system will accept before warning the operator and other information necessary for the microprocessor to perform its monitoring and analyzing function. Dedicated programming buttons for microprocessor 14 are also provided to perform, for example, calibration and diagnostic functions. LCD display 22 shows information being entered by the keypad and also displays status and diagnostic information about the system.

Printer 18 is a paper tape printer connected to microprocessor 14 by a conventional serial connection. The printer can be operated under the control of microprocessor 14 to produce a continuous printout of knife projections and other relevant information over time for record purposes. For example, as well as recording knife projection distances for each knife to pinpoint a knife that is starting to dull or is slipping, the printout can record the date and time, the preset programmed limits and the speed of the machine (RPM) as the information is gathered. The printer includes standard paper feed control buttons such as ONLINE, FF (form feed) and LF (line feed).

Above LCD display 22, there are a series of status lights 16 that permit the operator to determine the current operating condition of the cutting knives and the knife projection monitoring system at a glance. A plurality of LEDs are preferably provided and individual lights are illuminated under the control of microprocessor 14 to indicate:

1) Shutdown of the cutting machine—This LED lights if a shutdown condition occurs when the knife projection monitoring system has determined that the projection of at least one knife has moved outside a preset limit that makes further operation of the cutting machine dangerous. The operator can then take appropriate action.

2) Warning—This LED lights if a warning condition occurs to indicate that the knife projection monitoring system has determined that the projection of at least one knife has moved outside a preset warning limit that warrants attention by the operator.

3) Index—This LED flashes to indicate that the system has detected the index pulse from the encoder of the cutting machine. The encoder is used by the cutting machine to determine the speed and position of the rotatable knife mounting surface.

4) Knife 1—This LED flashes to indicate that the system as detected the first knife position which is stablished when setting up and calibrating the knife projection monitoring system to the cutting system.

5) Power Supply—A plurality of LED lights are used to indicate the power available for running and operation of the knife projection monitoring system.

In addition to status lights 16, the apparatus of the present invention is also preferably provided with a speaker 23 for sounding an audible alarm when a warning or shutdown condition is detected.

Furthermore, instead of simply informing the operator by a flashing LED or audible alarm of a dangerous operating condition, the knife projection monitoring system of the present invention also preferably includes an output channel 90 (see FIG. 1) controlled by microprocessor 14 for communicating with a supervisory controller 92 in cutting machine 3. Output channel 90 provides a warning signal or a shutdown signal to external supervisory controller 92 of the cutting machine dependent on the magnitude of the deviation of at least one of the plurality of cutting knives from the preset desirable limits.

A warning signal is generated when the projection of at least one knife exceeds a warning limit but is less than a shutdown limit. At the same time that microprocessor 14 sends the warning signal, it will also flash the appropriate LED on light array 16 and cause speaker 23 to issue a distinctive alarm. The number of times a warning signal for a particular knife is issued is monitored by microprocessor 14. If warnings are issued for a particular knife more than a preset number of times in a given period, a shutdown signal will be issued. Using the warning signal in this manner allows the knife projection monitoring system to disregard occasional anomalous knife projection readings that may be detected.

The shutdown signal is generated by microprocessor 14 when the projection of at least one knife exceeds a shutdown limit that is the maximum allowable projection distance of a knife for safe operation. The appropriate LED on light array 16 is also flashed and an audible alarm sounded on speaker 23. The shutdown signal causes the supervisory controller to automatically shutdown the cutting machine in the fastest manner possible.

As previously discussed, the warning and shutdown limits for the knife projection monitoring system are programmable to suit different cutting machines.

The knife projection monitoring system of the present invention is useful in two distinct modes of operation. In a first mode, the system is used to check the position and projection of knives as they are installed in the machine before the machine is run up to full speed. The operator installs all the cutting knives in the machine and then slowly rotates the knife mounting surface by hand or under power past the sensors so that the projection of each of the knives can be determined and the operator alerted if the installed knives are not positioned within preset limits. In an alternative installation scheme, the operator installs a cutting knife and slowly rotates the knife mounting surface past the sensors so that the projection of the individual knife can be determined by the system. Once a particular knife is properly installed, another knife is mounted and the process continued until knives are mounted.

In this first mode of operation, in which the cutting knives are rotated relatively slowly past the sensors, a conventional proximity sensor is suitable for acquiring projection data.

In the second mode, the knife monitoring system of the present system is used to supervise the projection of each knife while the cutting machine is operating at full speed. Sensors 4 and microprocessor 14 must monitor and determine the projection status of each knife as it rotates past the sensors every few milliseconds. In this second mode of operation, the Kaman Instrumentation KD-2300 linear position sensor mentioned previously is preferred as it is able to provide reliable data at the faster knife speeds of normal operation.

Although the present invention has been described in some detail by way of example for purposes of clarity and understanding, it will be apparent that certain changes and modifications may be practised within the scope of the appended claims.

What is claimed is:

1. A method for monitoring the position of cutting knives in a cutting machines having a rotatable surface adapted to retain a plurality of cutting knives comprising the steps of:

detecting the cutting knives using at least one stationary sensor as the knives rotate past the sensor, the sensor generating a signal capable of indicating the position of each cutting knife;

analyzing the signal generated by the at least one stationary sensor to determine the projection of each knife from a reference surface; and comparing the projection of each knife with preset desirable limits to determine if at least one of the knives exceeds the limits.

2. A method as claimed in claim 1 in which the at least one stationary sensor comprises an electronic linear position sensor that generates an output voltage signal that is proportional to the distance between the sensor and a metallic target surface.

3. A method as claimed in claim 2 in which the metallic target surface comprises the cutting knives and the rotatable surface to which the cutting knives are mounted.

4. A method as claimed in claim 3 adapted for use with a cutting machine in which the knives project a significant distance from the rotatable surface in the knives' normal operating position and in which the analyzing step comprises monitoring the amplitude of the voltage signal of the sensor to detect a peak that differentiates the knife cutting edge from the rotatable surface.

5. A method as claimed in claim 3 adapted for use with a cutting machine in which the knives project a relatively small distance from the rotatable surface in the knives' normal operating position and in which the analyzing step comprises monitoring the changes in the voltage signal of the sensor to detect a characteristic waveform shape that differentiates the knife cutting edge from the rotatable surface.

6. A method as claimed in claim 2 in which the signal generated by the at least one stationary sensor is analyzed by a program running on a programmable microprocessor.

7. A method as claimed in claim 1 including the additional step of communicating the knife projection status of the knives to an operator.

8. A method as claimed in claim 1 including the additional step of automatically stopping the cutting machine if the comparison step determines that the projection of at least one of the knives exceeds the preset limits.

9. A method as claimed in claim 1 wherein the plurality of cutting knives have cutting edges that project from the rotatable surface, and wherein analyzing the signal comprises analyzing the signal generated by the at least one stationary sensor to locate a portion of the signal that represents the cutting edge of each knife and determine the projection of each knife from a reference surface.

* * * * *